United States Patent [19]

Noda et al.

[11] Patent Number: 4,596,616

[45] Date of Patent: Jun. 24, 1986

[54] METHOD OF BASTING IN THE TAILORING OF CLOTHES

[75] Inventors: Toshio Noda, Kawasaki; Toshio Teramoto, Yokohama; Masahiro Niinomi, Machida; Kazunari Kamiyama, Saitama; Akira Uchiyama, Yokohama; Takashi Harada, Ueno, all of Japan

[73] Assignees: Tokyo Men's Apparel Corp.; Japan Synthetic Rubber Co., Ltd., both of Tokyo, Japan

[21] Appl. No.: 617,537

[22] Filed: Jun. 5, 1984

[51] Int. Cl.[4] ..... B32B 7/08; B32B 31/00

[52] U.S. Cl. ..... 156/93; 2/272; 2/275; 112/262.1; 112/441; 156/155; 156/247; 156/254; 156/307.3; 156/329; 156/344; 428/102; 428/103; 428/104

[58] Field of Search ..... 156/93, 329, 307.3, 156/155, 254, 247, 344; 2/272, 275; 428/196, 102, 104, 103; 528/24; 112/262.1, 441

[56] References Cited

U.S. PATENT DOCUMENTS

| | | | |
|---|---|---|---|
| 1,330,631 | 2/1920 | Greenwald | 2/272 |
| 2,539,244 | 1/1951 | Halden | 112/262.1 |
| 3,137,864 | 6/1964 | Ostmann | 156/254 |
| 3,390,036 | 6/1968 | Wright et al. | 156/93 |
| 4,033,924 | 7/1977 | Mine et al. | 528/24 |

FOREIGN PATENT DOCUMENTS

| | | | |
|---|---|---|---|
| 2211474 | 9/1972 | Fed. Rep. of Germany | 156/329 |
| 47-33653 | 8/1972 | Japan | 156/93 |
| 444012 | 3/1936 | United Kingdom | 2/275 |

*Primary Examiner*—John J. Gallagher

*Attorney, Agent, or Firm*—Oblon, Fisher, Spivak, McClelland & Maier

[57] ABSTRACT

In a method of basting in the tailoring of clothes wherein an adhesive is used to secure the cloth, the improvement wherein said adhesive comprises as the main component a liquid, addition-reaction-type silicone polymer. Said basting method is applicable to basting interlinings and/or shoulder pads to front bodices, basting two back bodices and the like to simplify and automatize the tailoring process.

15 Claims, 15 Drawing Figures

METHOD OF BASTING IN THE TAILORING OF CLOTHES

Figure 1:
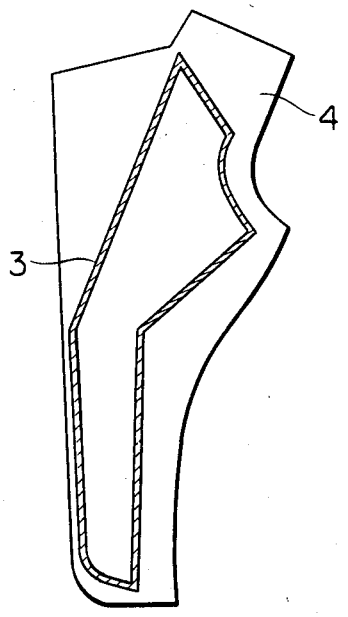

This invention relates to a method of basting in the tailoring of clothes.

In the process for tailoring clothes composed of 2 or 3 layers such as suitings, linings and interlinings used in clothings, particularly coats and suits, basting has heretofore been necessary for preventing the two or three layers from slipping out of position or preventing balance from being broken when sewing different fabrics, for example, suitings and linings. Accordingly, the basting is important for obtaining a good quality in the sewing work.

In general, when two sheets of cloth are basted, a jamping sewing machine is used. In the basting of a three-dimensional portion such as the basting of interlinings or the basting of facings, the sewing must be conducted so that the outer track clotch absorbs the difference in length from the inner track clotch or the room for preventing the outer track cloth from being partially stretched. Therefore, the sheets of cloth must be delicately manipulated by hand such as by shirring or elongating the cloth while running the sewing machine. Thus, workers are required to have experience and skill for such a complicated technique. Therefore, the quality and productivity are not constant. Also, basting of interlinings is the manner of securing the haircloth and the front bodice which is the basic working in tailoring. However, the front bodice must be three-dimensionally designed to accommodate the volume of chest and the indention of waist, and hence, working is difficult. A difficult technique is required to meet the requirements that after the basting of interlinings the front bodice should not be in excess of the interlinings and that the warp of the clotch is straight. As a further requirement, the finishing should be such that the cloth is naturally internally curled corresponding to the curve of the bust and waist. Accordingly, in the conventional sewing process, the basting working including conventional basting and basting of interlinings and shoulder pads in tailoring a suit cannot be omitted, and the working is completely manual and requires skill. Therefore, it is difficult to increase production efficiency and to render the products uniform by automation and labor-reduction.

This invention aims at providing a basting method which can be substituted for the conventional method of basting sheets of cloth with thread. The invention comprises applying a thermosetting adhesive comprising as the main component a liquid, addition-reaction-type silicone polymer to the necessary peripheral portions of one of the sheets of cloth to be secured, setting the sheets with the adhesive between them on a base board or the fixed base of a press and heat-pressing the resulting assembly in order to stabilize the quality and increase production efficiency, thereby reducing skilled manual labor and enabling partial automation of the sewing operation. Thus, the method enables a product having a uniform and stable quality to be produced in a short time, and increases the production efficiency.

According to this invention, there is provided a method of basting sheets of cloth in tailoring clothes, which comprises applying a thermosetting adhesive comprising as the main component a liquid, addition-reaction-type silicone polymer, to the necessary portions of one of the sheets of cloth, setting the cloth with the adhesive and the other sheet or sheets of cloth on a base board so that the adhesive is present between the sheets of cloth, heat-pressing the resulting assembly to secure the sheets of cloth with the adhesive. The thus basted sheets can be easily peeled off from each other by hand without damaging the cloth.

In this invention, the material for the cloth to be used is not critical, and may be of a natural fiber such as cotton, linen, wool, cashmere or the like, or a regenerated or semi-synthetic fiber such as rayon, acetate or the like, or a synthetic fiber such as polyester fiber, polyamide fiber, acrylic fiber or the like. These may be used along or in admixture.

Other objects and advantages of this invention will become apparent from the following description and the accompanying drawings.

Figure 2:
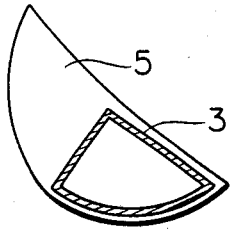
Figure 3:
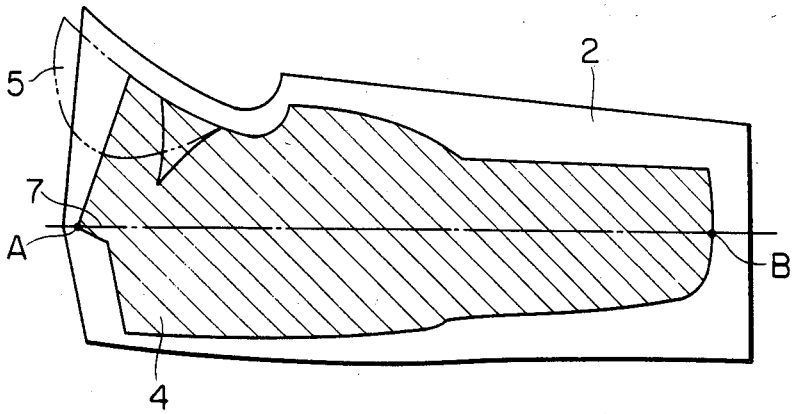
Figure 4:
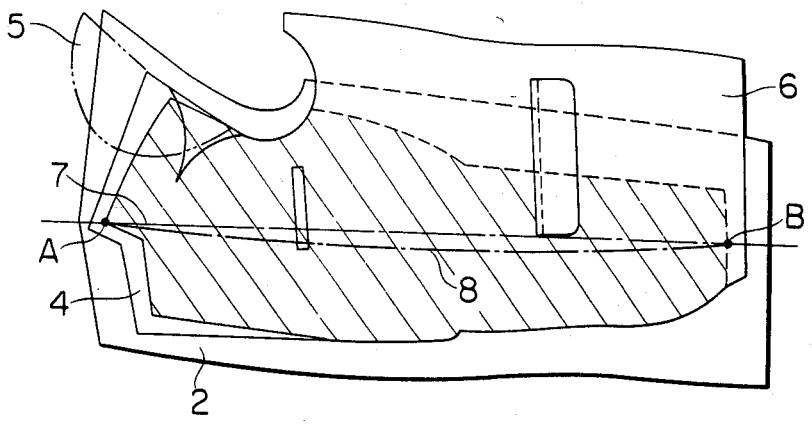
Figure 5:
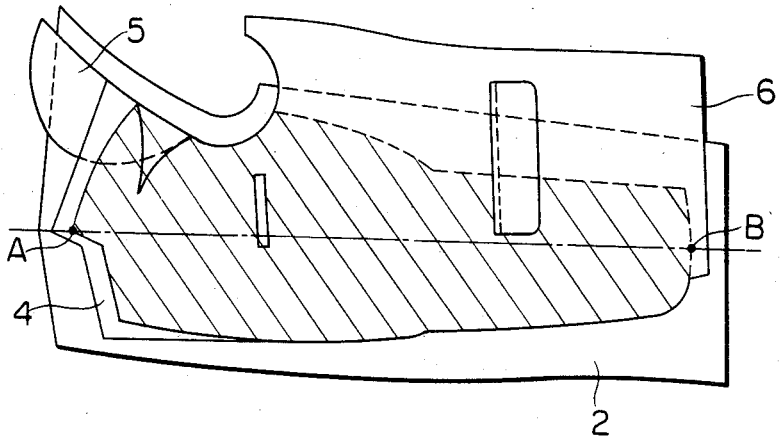
Figure 6:
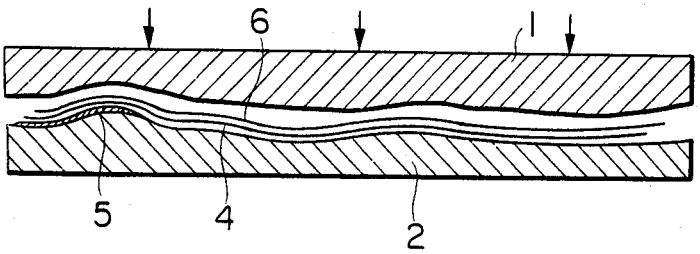
Figure 7:
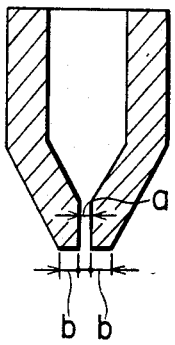
Figure 8:
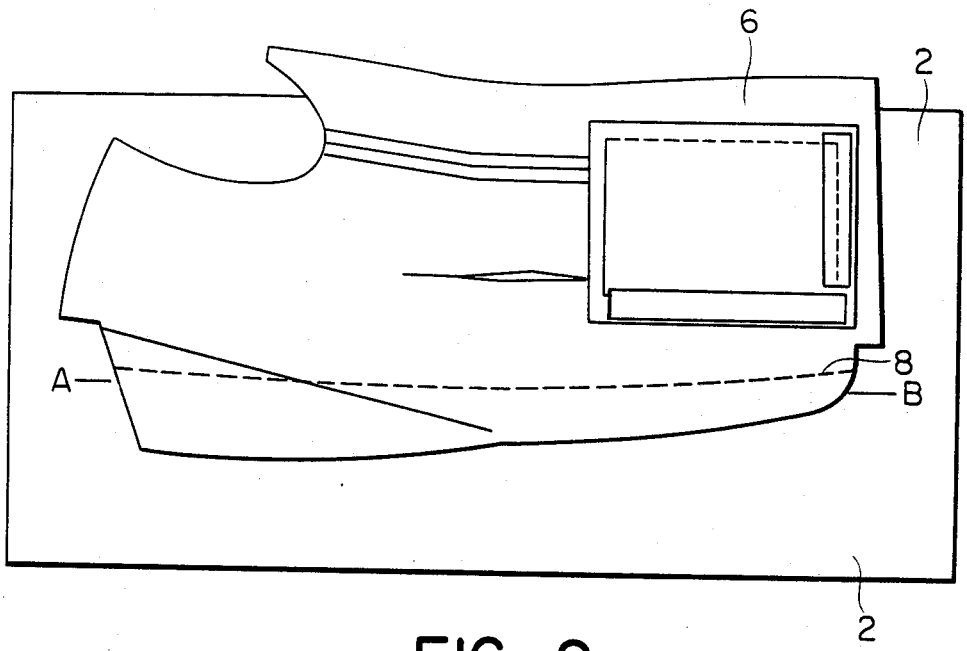
Figure 9:
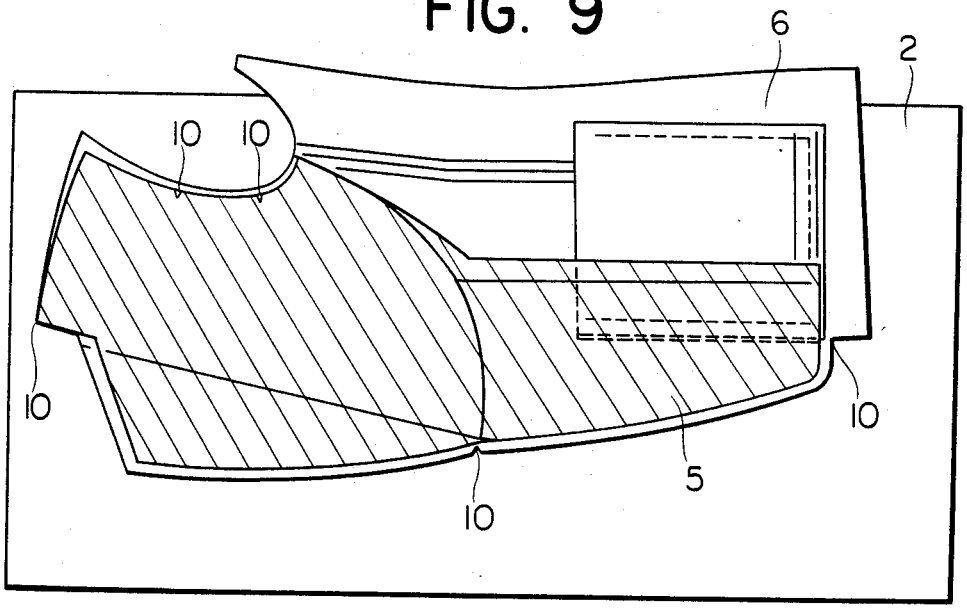
Figure 10:
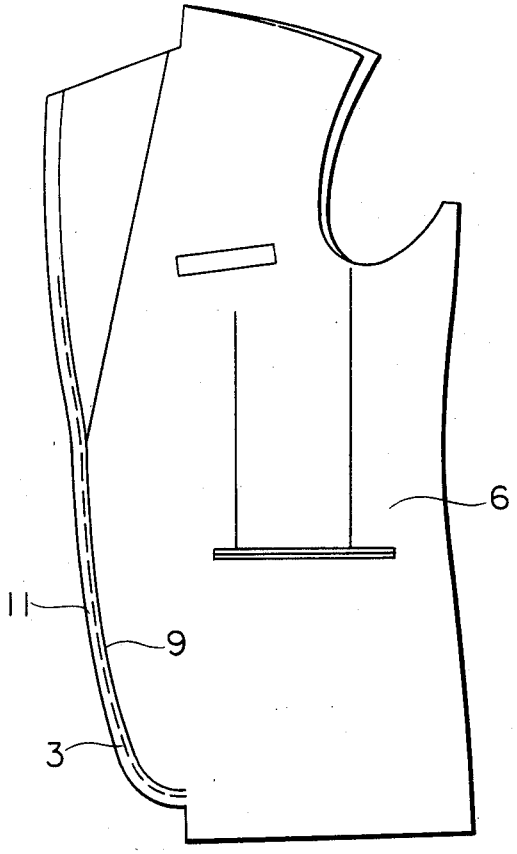
Figure 11:
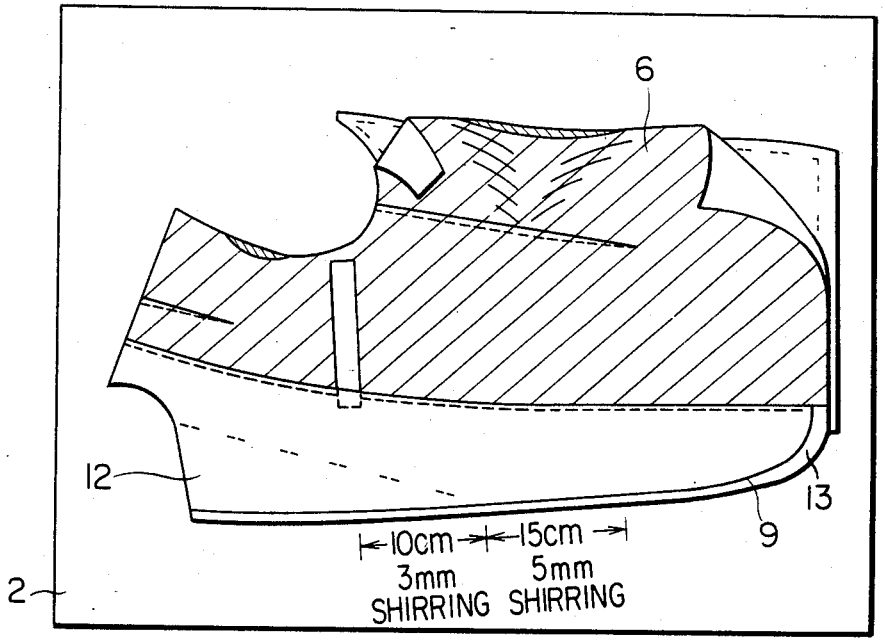
Figure 12:
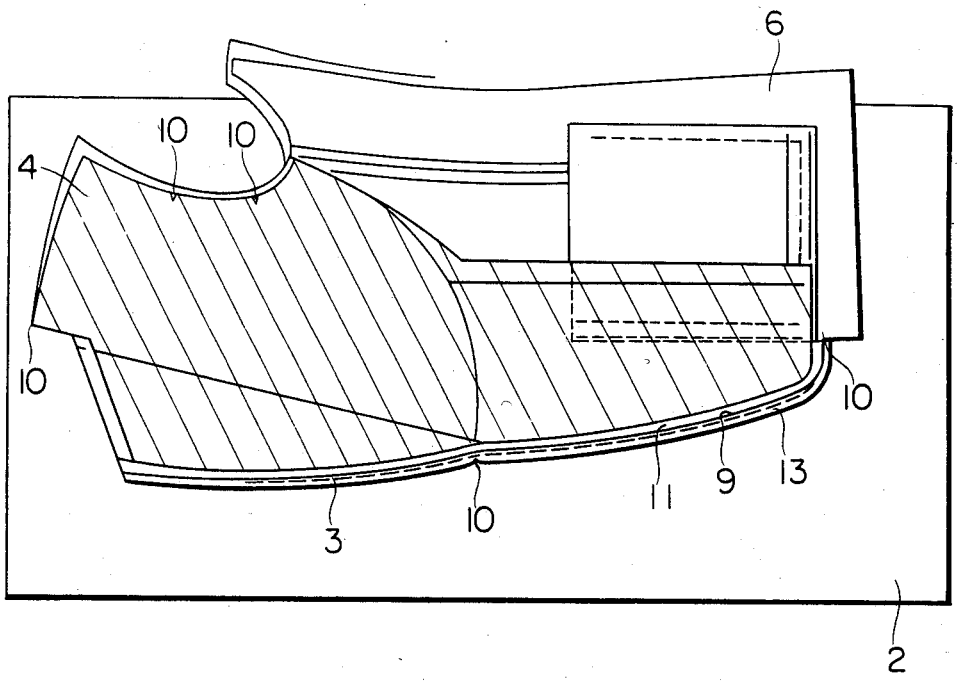
Figure 13:
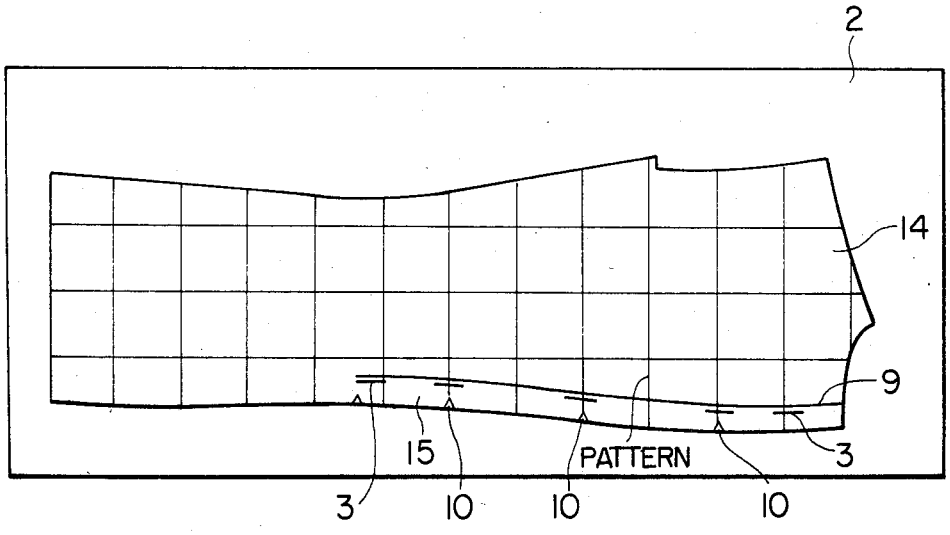
Figure 14:
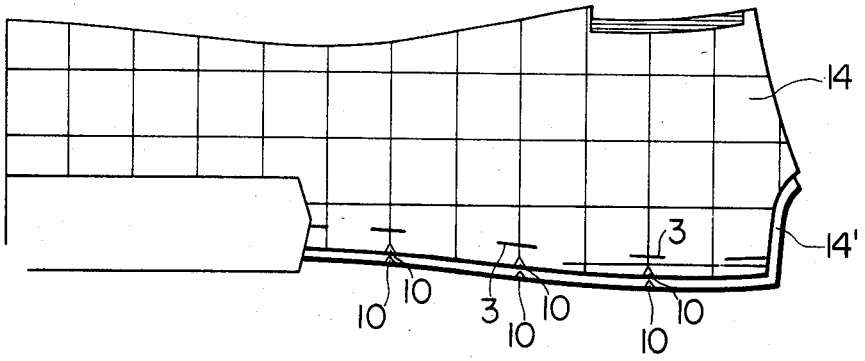
Figure 15:
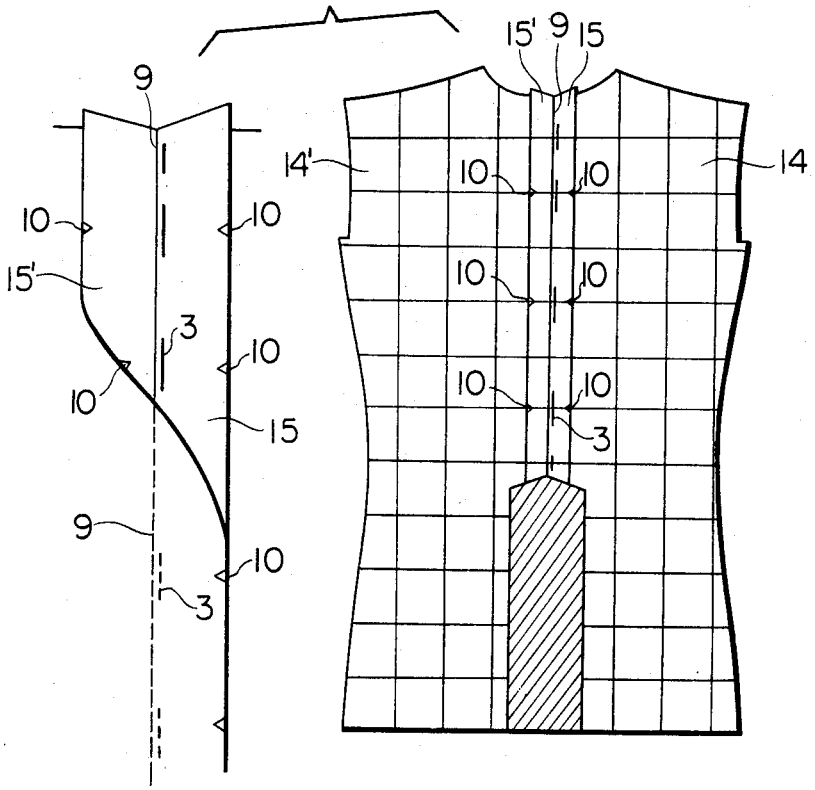

In the accompanying drawings,

FIG. 1 shows a rough plan view of haircloth used in the basting method of this invention, FIG. 2 shows a rough plan view of a shoulder pad used in the present basting method, FIG. 3 to FIG. 6 show rough plan views of each step of beating interlinings for the basting method of this invention, FIG. 7 shows a longitudinal section of a nozzle used in applying an adhesive to cloth in the basting method of this invention, FIG. 8 and FIG. 9 show rough plan views of the steps of another mode of the basting method of this invention, FIGS. 10–12 show rough plan views of the steps of basting the facing, and FIGS. 13–15 show rough plan views of the steps of basting two back bodice pieces.

Common reference numbers are used in FIGS. 1–15, and reference numeral 1 refers to the movable member of a press, 2 to the fixed base of a press, 3 to an adhesive, 4 to haircloth, 5 to a shoulder pad, 6 to a front of a bodice, 7 to the warp of the haircloth 4, 8 to the warp of the front of a bodice 6, A and B to points on the base board 2 for fitting the warp 7 of the haircloth 4 or the warp 8 of the front of a bodice 6, 9 to the final sewing line, 10 to points for fitting the haircloth 4 and the front of a bodice 6, 11 to the margin to sew up the front of a bodice 6, 12 to the facing, 13 to the margin to sew up the facing, 14 and 14' to the back bodice pieces, 15 and 15' to the margins to sew up the back bodice pieces 14 and 14', a to the diameter of the nozzle, and b to the wall thickness of the end of the nozzle.

As shown in FIGS. 1 and 2, the present adhesive 3 is applied to the haircloth 4 and the shoulder pad 5 by means of an appropriate commercially available application machine. The adhesive is applied in such a thickness and a width that the adhesive does not ooze through even thin cloth for a summer suit, preferably a thickness of 0.01–2 mm and a width of 0.1–10 mm, more preferably a thickness of 0.05–0.8 mm and a width of 0.3–3 mm.

Preferably, the application machine is such that the adhesive can be extruded continuously or intermittently at a constant rate in the form of a fine line, and the nozzle used in this case has preferably a caliber of 0.2–1 mm (see a in FIG. 7) and a wall thickness of 0.1–0.8 mm at the tip (see b in FIG. 7). When a is less than 0.2 mm, the nozzle tends to be blocked with the adhesive, and when it is more than 1 mm, the adhesive is apt to ooze through the cloth. When b is less than 0.1 mm the strength of the nozzle is not sufficient, and when it exceeds 0.8 mm, the adhesive adheres to the outlet of the nozzle to make it impossible for the adhesive to be extruded in the form of a fine line.

The adhesive used in this invention is a composition comprising a liquid, addition-reaction-type silicone polymer as the main component; a curing agent; and if necessary, an antistatic agent, a filler, a copolymerizable monomer and other additives.

The liquid, addition-reaction-type silicone polymer is a polysiloxane compound which can be converted into a higher molecular weight polymer by an addition reaction which proceeds upon heating in the presence of a curing agent. The said polysiloxane compound includes, for example, poly-$C_{1-12}$alkyl-$C_{2-12}$alkenylsiloxane, poly-substituted $C_{1-12}$alkyl-$C_{2-12}$alkenylsiloxane (substituent: halogen or the like), polyphenyl-$C_{2-12}$alkenylsiloxane, poly-substituted phenyl-$C_{2-12}$alkenylsiloxane (substituent: alkyl, halogen or the like), poly-$C_{1-12}$alkylhydrogensiloxane, poly-substituted $C_{1-12}$alkylhydrogensiloxane (substituent: halogen or the like), polyphenylhydrogensiloxane, and poly-substituted phenylhydrogensiloxane (substituent: alkyl, halogen or the like), and these may be used alone or in admixture. Preferably, a mixture of the polyalkylhydrogensiloxane, the poly-substituted alkylhydrogensiloxane, the polyphenylhydrogensiloxane or the poly-substituted phenylhydrogensiloxane with one of the other siloxanes may be used.

The curing agent includes organic peroxides such as 2,4-dichlorobenzoyl peroxide, o-methylbenzoyl peroxide, p-chlorobenzoyl peroxide, o-chlorobenzoyl peroxide, lauroyl peroxide, bis-3,5,5-trimethylhexanoyl peroxide, benzoyl peroxide, dicumyl peroxide, 1,1-di-t-butylperoxy-3,3,5-trimethylcyclohexane, t-butylperoxypivalate, t-butylperoxy-2-ethylhexanoate, bis(4-t-butylcyclohexyl)peroxydicarbonate, methyl ethyl ketone peroxide and the like; platinum compounds, rhodium compounds, palladium compounds, etc. They may be used alone or in admixture of two or more. Preferably, a combination of an organic peroxide with a platinum compound is used. Among the organic peroxides, 2,4-dichlorobenzoyl peroxide is preferred. The proportion of the organic peroxide is preferably 1–30 parts by weight, more preferably 5–20 parts by weight, per 100 parts by weight of the silicone polymer.

In this invention, antistatic agents may be used alone or in combination of two or more, and the proportion thereof is preferably 0.01 to 10 parts by weight, more preferably 0.1 to 5 parts by weight, per 100 parts by weight of the silicone polymer. As the antistatic agent, there may be used anionic surfactants, cationic surfactants, nonionic surfactants and amphoteric surfactants. As the anionic surfactants, there may be used, for example, fatty acid soap, alkylsulfate, sodium dodecylbenzenesulfonate, and the like, and as the cationic surfactants, there may be used, for example, octadecyltrimethylammoniumchloride, dodecyltrimethylammoniumchloride, alkyltrimethylammoniumchloride, hexadecylltrimethylammonium chloride, oxyethylenedodecylamine, polyoxyethylenedodecylamine, an isopropanol solution of alkylolaminopropyldimethyl-2'-hydroxylethyl ammonium salt and the like; and as the nonionic surfactants, there may be used, for example, polyoxyethylenestearylether, polyoxyethyleneoctylphenolether, fatty acid diethanol amide and the like; and as the amphoteric surfactants, there may be used, for example, dimethylalkylbetaine and the like.

In the case of using the antistatic agents, a fine line of adhesive can be easily obtained when the adhesive is extruded from the application machine.

Examples of the optionally added additives include fillers and copolymerizable monomers. The fillers include, for example, carbon black, anhydrous or hydrous silicone dioxide, calcium carbonate, calcium silicate, magnesium carbonate, titanium oxide, zinc oxide, clay, alumina, talc and the like. The proportion of the filler is preferably 0–300 parts by weight per 100 parts by weight of the silicone polymer. Preferable examples of the polymerizable monomer are polyfunctional acrylate or methacrylate monomers, for example, polyethylene glycol diacrylate, polyethylene glycol dimethacrylate, 1,3-butylene glycol diacrylate, 1,3-butylene glycol dimethacrylate, 1,4-butylene glycol diacrylate, 1,4-butylene glycol dimethacrylate, 1,6-hexane glycol diacrylate, 1,6-hexane glycol dimethacrylate, neopentyl glycol diacrylate, neopentyl glycol dimethacrylate, dipropylene glycol diacrylate, dipropylene glycol dimethacrylate, polypropylene glycol diacrylate, polypropylene glycol dimethacrylate, 2,2-bis(4-acryloxydiethoxyphenyl)propane, 2,2-bis(4-methacryloxydiethoxyphenyl)propane, 2,2-bis(4-acryloxypropyldiphenyl)propane, trimethylolpropane triacrylate, trimethylolpropane trimethacrylate and the like. The proportion of the copolymerizable monomer is preferably 0 to 20 parts by weight per 100 parts by weight of the silicone polymer.

The viscosity and other properties of the adhesive obtained may be varied depending upon the kind and proportion of the above additives added. The fluidity and other characteristics of the adhesive in the heat-pressing and the elasticity, hardness and other characteristics of the adhesive after the heat-pressing may also be varied depending upon the kind and amount of the additives added. The viscosity of the adhesive is preferably 1,000 to 5,000,000 cP more preferably 100,000 to 2,000,000 cP in view of the applicability of the adhesive and prevention of the adhesive from oozing through the cloth.

Thus, the haircloth 4 having applied thereto the adhesive 3 is set while fitting the warp 7 of the haircloth 4 to the A-B line on a base board 2, for example, the fixed base of a press which has usually the necessary concave and convex surface as shown in FIG. 6. Subsequently, the front of the bodice 6 is put on the haircloth 4 while fitting the warp 8 of the front of the bodice 6 to the line 7 as in FIG. 4. In this embodiment, the haircloth 4 is first put on the base board 2 and the front of the bodice 6 is then put on the haircloth 4, but in another embodiment, the front of the bodice 6 is first put on the base board as shown in FIG. 8 and the haircloth 4 is thereafter put on the front of the bodice 6 while fitting the points 10 as shown in FIG. 9. If necessary, the shoulder pad 5 having applied thereto the adhesive 3 is placed in the predetermined position under the haircloth 4 as in FIG. 5, whereby the preparatory working before basting is completed. When the warp of the cloth is adjusted to the A-B line on the base board, the use of a photoelectric tube, for example, may facilitate the working.

The resulting assembly consisting of the haircloth 4, the front of the bodice 6 and if neccessary, the shoulder pad 5 on the fixed base 2 of a press is heat-pressed by means of the movable member 1 of the press at a predetermined temperature (for example, 60°–200° C., preferably 100°–150° C.) under a predetermined pressure (for example, 0.01–2 kg/cm$^2$, preferably 0.05–0.15 kg/cm$^2$) for a predetermined period of time (for example, 1–600 sec, preferably 5–60 sec) while applying steam thereto, thereby appropriately securing the haircloth 4, the front bodice 6 and if necessary, the shoulder pad 5 to one another (see FIG. 6). Thus, the basting of interlining which is the most difficult step in the process for tailoring clothes can be carried out simply in a very short period of time by the present basting method regardless of the technical level of worker. The thus basted assembly consisting of haircloth 4, the front bodice 6 and if necessary, the shoulder pad 5 is subjected to a conventional final sewing, after which the portions secured with the adhesive can easily be peeled off by lightly pulling the haircloth 4 and the front of the bodice 6 at the secured portions in the opposite direction without damaging the cloth. As a result, one can avoid an unpleasant appearance due to, for example, puckering resulting from the difference in shrinkage between the secured portion and the unsecured portion, said appearance being noticeable from the outside of the front of the bodice. Moreover, since is thermosetting, the adhesive once it is cured by heat-pressing, it cannot secure again the front of the bodice to the interlining even when the suit is subjected to finishing press, and hence, no unpleasant appearance such as puckering results from the finishing press. In addition, the present basting method does not require the conventional step of withdrawing the basting threads, and hence, the disadvantages resulting from the said conventional step can be overcome by the present basting method.

Though not shown in the drawings, the adhesive 3 may be applied to the front of the bodice 6 instead of the haircloth 4, and the above procedure may be repeated.

Further, a method of basting the facing is explained below.

As shown in FIG. 10, the preparatory working for basting the facing in tailoring clothes includes the step of applying the thermosetting adhesive 3 to the margin to sew up 11 of the front of the bodice 6 at a position 0.1–5 mm distant, preferably 0.3–2 mm, distant from the final sewing line 9 for facing in the form of a solid line or broken line having a width of 0.1–1 mm (in the case of broken line, the length and space can appropriately be selected), and setting the front of the bodice 6 having applied thereto the adhesive on a base board such as the fixed base of a press, putting the facing 12 on the front of the bodice 6 while fitting points on the facing 12 to the corresponding points on the front of the bodice 6 so as to give the necessary shirring amount as shown in, for example, FIG. 11, and heat-pressing the resulting assembly by means of an iron or a press and a temperature of 60°–200° C. at a pressure of 0.01–2 kg/cm$^2$ for a period of 1–600 seconds to secure the facing to the front of the bodice. Subsequently, the thus secured assembly is subjected to final sewing in a conventional manner. After the final sewing, the margins to sew up 11 and 13 of the front of the bodice and the facing are separated, and simultaneously, the secured portions are also easily peeled off (see FIG. 12).

A further embodiment of the present basting method is the basting for the final sewing of back bodice pieces 14 and 14' at the back center. As shown in FIG. 13, the thermosetting adhesive 3 is applied to the margin to sew up 15 of one of the back bodice pieces 14 and 14' along the final sewing line 9 at the back center but 0.1–5 mm distant, preferably 0.3–2 mm distant, from said final sewing line 9 in the form of a solid line or broken line having a width of 0.1–1 mm. The back bodice piece 14 having applied thereto the adhesive is set on a flat board 2 such as the fixed base of a press, after which the other back bodice piece 14' is put thereon while fitting points on the two back bodices for preventing puckering and fitting the patterns of both back bodice pieces 14 and 14' as shown in FIG. 14, and the resulting assembly is heat-pressed by means of an iron or the movable member of the press at a temperature of 60°–200° C. and a pressure of 0.01–2 kg/cm$^2$ for a period of 1–600 seconds, thereby securing the two back bodice pieces 14 and 14' at the back center line. The thus secured assembly is subjected to final sewing in a conventional manner, and then to separation of the margins, whereby the portions secured with the adhesive are easily peeled off (see FIG. 15). This basting method can also be applied to the final sewing of the side piece and the front bodice or back bodice, to the final sewing of top sleeve and under sleeve, and to the final sewing of top side and under side of pants.

The basting of the back bodice pieces with a thermosetting adhesive, particularly when it is applied to for thin cloth for summer suit, can prevent the slippage of cloth resulting from sewing by a sewing machine.

As can be seen from the above description, the present basting method can give a product having a uniform and stable quality. Moreover, the present basting method can be applied not only to the basting of interlinings including attaching a shoulder pad but also to all other basting steps in tailoring. By applying the present basting method, the sewing process can be partially automated even in the case of tailoring summer suits, and can be speeded up, whereby the quality of product and the production efficiency can be enhanced.

The thermosetting adhesive comprises as the main component a liquid, addition-reaction-type silicone polymer and it can provisionally secure sheets of cloth at a considerably lower temperature under a considerably lower pressure than conventional permanent adhesives used for securing sheets of cloth (hot-melt adhesives such as polyester, polyamides and the like). Therefore, the cloth is not damaged and the pressing time can be shortened. Accordingly, sheets of cloth can easily be secured by means of an iron, and the thus secured sheets of cloth can easily be peeled apart, but the adhesive cannot secure the thus peeled sheets of cloth even when heat-pressing is applied thereto again.

This invention is further explained in detail below referring to Examples, but it should be interpreted that this invention should not be limited to the Examples. The "Silicone A", "Silicone B", "Silicone C", "Silicone D", "Silicone E", "Silicone F", and "Silicone G" used in the Examples are as follows, and the part used in the Examples is by weight unless otherwise specified:

Silicone A:

Polymethylvinylsiloxane, viscosity at 20° C. of 5,000 cP;

Silicone B:

Polymethylhydrogensiloxane, viscosity at 20° C. of 5,000 cP;

Silicone C:

Polymethylvinylsiloxane, viscosity at 20° C. of 3,000 cP;

Silicone D:

Polymethylhydrogensiloxane, viscosity at 20° C. of 3,000 cP;

Silicone E:

Polytrifluoropropylallylsiloxane, viscosity at 20° C. of 3,000 cP;

Silicone F:

Polytrifluoropropylhydrogensiloxane, viscosity at 20° C. of 3,000 cP;

Silicone G:

Polyphenylvinylsiloxane, viscosity at 20° C. of 2,000 cP.

Further, in the Examples, the viscosity is a value obtained by means of a rheometer "RHEOMAT 30" manufactured by Contraves at a shear rate of 10 $sec^{-1}$.

EXAMPLE 1-6

With the following compounding recipies, various components were mixed by means of an internal mixer to prepare six adhesives:

Example 1

Silicone A: 50 parts
Silicone B: 50 parts
2,4-Dichlorobenzoyl peroxide: 4 parts
Chloroplatinic acid: 0.1 part
Silicone dioxide (hydrous): 20 parts
The viscosity at 20° C. of said adhesive is 600,000 cP.

Example 2

Silicone C: 50 parts
Silicone D: 50 parts
2,4-Dichlorobenzoyl peroxide: 8 parts
Silicone dioxide (anhydrous): 20 parts
Talc: 100 parts
Dodecyltrimethylammonium chloride: 0.5 part
The viscosity at 20° C. of said adhesive is 1,500,000 cP.

Example 3

Silicone E: 50 parts
Silicone F: 50 parts
Benzoyl peroxide: 5 parts
Chloroplatinic acid: 0.5 part
Silicone dioxide (hydrous): 30 parts
The viscosity at 20° C. of said adhesive is 1,000,000 cP.

Example 4

Silicone G: 50 parts
Silicone B: 50 parts
2,4-Dichlorobenzoyl peroxide: 15 parts
Calcium carbonate: 120 parts
The viscosity at 20° C. of said adhesive is 200,000 cP.

Example 5

Silicone A: 50 parts
Silicone B: 50 parts
Chloroplatinic acid: 0.2 part
Silicone dioxide (hydrous): 25 parts
The viscosity at 20° C. of said adhesive is 1,000,000 cP.

Example 6

Silicone C: 50 parts
Silicone D: 50 parts
Dicumyl peroxide: 8 parts
Trimethylolpropane trimethacrylate: 8 parts
Talc: 50 parts
Octadecyltrimethylammonium chloride: 1 part
The viscosity at 20° C. of said adhesive is 500,000 cP.

Each of the adhesives thus obtained was applied to a piece of wool suit cloth in the form of a line having a width of 2.5 mm and a thickness of 0.24 mm and a piece of haircloth was put thereon, after which the resulting assembly was heat-pressed at a temperature of 120° C. at a pressure of 0.15 $kg/cm^2$ for 30 sec. Thereafter, the pieces of cloth were drawn at an angle of 90° at a rate of 50 mm/min to examine the necessary tensile force for peeling the pieces (peeling strength). The results obtained are shown in Table 1.

TABLE 1

| Example No. | 1 | 2 | 3 | 4 | 5 | 6 |
|---|---|---|---|---|---|---|
| Peeling strength (g) | 900 | 1020 | 950 | 1200 | 860 | 950 |

As is clear from the results in Table 1, all the adhesives indicate a peeling strength of more than 500 g by heat-pressing at a relatively low temperature at a relatively low pressure for a short period of time, and when the adhesives have a peel strength of more than 500 g, they are not objectionable in practice.

Example 7

Silicone A: 50 parts
Silicone B: 50 parts
2,4-Dichlorobenzoyl peroxide: 8 parts
Silicone dioxide (hydrous): 20 parts The above components were treated in the same manner as in Example 1 to prepare an adhesive.

Using this adhesive, a piece of wool suit cloth and a piece of haircloth were secured under the same conditions as in Example 1, and the peeling strength was measured in the same manner as in Example 1, to obtain the results shown in Table 2.

TABLE 2

| Run No. | | 1 | 2 | 3 | 4 | 5 |
|---|---|---|---|---|---|---|
| Condition | Temperature (°C.) | 140 | 120 | 100 | 140 | 120 |
| | Time (sec.) | 50 | 60 | 50 | 30 | 40 |
| Peeling strength (g) | | 1675 | 1200 | 572 | 1870 | 1180 |

Furthermore, the same procedure as above was repeated, except that a piece of cotton cloth or a piece of polyester cloth was substituted for the wool cloth, the temperature was changed to 120° C., and the time was changed to 40 sec., to obtain a peeling strength of 1015 g for the cotton cloth and 580 g for the polyester cloth.

Example 8

Silicone A: 100 parts
Silicone dioxide (anhydrous): 15 parts
1,3-Butylene glycol diacrylate: 10 parts
Dicumyl peroxide: 8 parts The above components were treated in the same manner as in Example 1 to prepare an adhesive.

The same procedure as in Example 1 was repeated, except that said adhesive was substituted, the application width was changed and the pressing temperature and time were changed to at 110° C. for 40 sec. The results obtained are shown in Table 3.

TABLE 3

| Run No. | 1 | 2 | 3 |
|---|---|---|---|
| Application width (cm) | 2.5 | 4.0 | 5.0 |
| Peeling strength (g) | 723 | 1217 | 1626 |

In each of run Nos. 1 to 3, the state of the cloth at the secured portions was observed with the naked eye and the texture of the cloth was examined by hand. As a result, it was confirmed that in each case, the texture was comparable to that obtained by sewing.

What is claimed is:

1. A method of basting sheets of cloth in the tailoring clothes, which comprises:

applying a thermosetting adhesive comprising as a main component a liquid, addition-reaction type silicon polymer to a first sheet of cloth, setting said first sheet of cloth on a flat base support such that the adhesive is situated between said first sheet of cloth and a second sheet of cloth, heat-pressing the sheets of cloth so that said sheets are secured with the adhesive, subjecting said sheets of cloth to conventional sewing so that they are attached to each other by thread, and separating the adhered portions of said sheets of cloth.

2. A method of basting according to claim 1, wherein the basting is conducted between the interlining, the shoulder pad and the suit cloth.

3. A method of basting according to claim 1, wherein the basting is conducted between the interlining and the suit cloth.

4. A method of basting according to claim 3, wherein the interlining is haircloth, and the suit cloth is the front of a bodice.

5. A method of basting according to claim 1, wherein the basting is conducted between two sheets of suit cloth.

6. A method of basting according to claim 5, wherein one of the sheets is the front of a bodice and the other is the facing.

7. A method of basting according to claim 5, wherein the two sheets are back bodice pieces.

8. A method of basting according to claim 4, which comprises applying the adhesive at the desired place of the haircloth, setting the haircloth with the adhesive facing up on the fixed base of a press so that the warp of the haircloth is fit to the predetermined line, putting the front of a bodice on the haircloth so that the warp of the front of a bodice is fit to the warp of the haircloth, and pressing the resulting assembly by means of the movable member of the press at a predetermined temperature under a predetermined pressure for a predetermined period of time to secure the front of a bodice to the haircloth.

9. A method of basting according to claim 6, which comprises applying the adhesive to the margin of the front of the bodice which is to be sewn, putting the facing thereon while fitting points on the facing to the corresponding points on the front of the bodice and pressing the resulting assembly by means of a hot press or iron at a predetermined temperature under a predetermined pressure for a predetermined period of time to secure the facing to the front of the bodice.

10. A method of basting according to claim 5, which comprises applying the adhesive in the form of a fine line to the margin of one of the two sheets of cloth to be sewn up, putting thereon the other sheet of cloth while fitting the patterns or points of the two sheets, pressing the resulting assembly by a hot press or an iron at a predetermined temperature under a predetermined pressure for a predetermined period of time to secure the sheets of cloth, and thereafter subjecting the secured assembly to final sewing.

11. A method of basting according to claim 4, which comprises applying the adhesive to the peripheral portions of the haircloth and a shoulder pad, putting the haircloth with the adhesive facing up on the fixed base of a press while fitting the warp of the cloth to the predetermined line on the base, putting the front of the bodice thereon while fitting the warp of the front of the bodice to that of the haircloth, putting the shoulder pad with the adhesive facing up between the base and the haircloth at the predetermined position, and then pressing the resulting assembly by means of the movable member of the prese at a predetermined temperature under a predetermined pressure for a predetermined period of time, to secure the front of the bodice, the haircloth and the shoulder pad.

12. A method of basting according to claim 4, which comprises applying the adhesive to the predetermined peripheral portions of the haircloth, setting the front of the bodice on the fixed base of a press while fitting the warp of the front of the bodice to the predetermined line on the fixed base, putting thereon the haircloth with the adhesive facing down while fitting the warp of the haircloth to the warp of the front of the bodice, and then pressing the resulting assembly by means of the movable member of the press at a predetermined temperature under a predetermined pressure for a predetermined period of time, to secure the haircloth and the front of the bodice.

13. A method according to claim 1, wherein the thermosetting adhesive comprises, in addition to the silicone polymer, a curing agent.

14. A method according to claim 1, wherein the thermosetting adhesive comprises, in addition to the silicone polymer, a curing agent and an antistatic agent.

15. A method according to claim 1, wherein the silicone polymer is a mixture of a poly-$C_{1-12}$alkylhydrogensiloxane, poly-halogen-substituted $C_{1-12}$alkylhydrogensiloxane, polyphenylhydrogensiloxane or poly-alkyl or halogen-substituted phenylhydrogensiloxane with a poly-$C_{1-12}$alkyl-$C_{2-12}$alkenylsiloxane, a poly-halogen-substituted $C_{1-12}$alkyl-$C_{2-12}$alkenylsiloxane, a polyphenyl-$C_{2-12}$alkenylsiloxane, or a poly-alkyl or halogen-substituted phenyl-$C_{2-12}$alkenylsiloxane.

* * * * *